US011322055B2

(12) United States Patent
Short

(10) Patent No.: US 11,322,055 B2
(45) Date of Patent: May 3, 2022

(54) LOCATING AND IDENTIFYING DEVICE

(71) Applicant: John Short, Orlando, FL (US)

(72) Inventor: John Short, Orlando, FL (US)

( * ) Notice: Subject to any disclaimer, the term of this patent is extended or adjusted under 35 U.S.C. 154(b) by 436 days.

(21) Appl. No.: 16/419,770

(22) Filed: May 22, 2019

(65) Prior Publication Data

US 2020/0372843 A1 Nov. 26, 2020

(51) Int. Cl.
*G09F 17/00* (2006.01)

(52) U.S. Cl.
CPC ..... *G09F 17/00* (2013.01); *G09F 2017/0066* (2013.01); *G09F 2017/0075* (2013.01); *G09F 2017/0083* (2013.01)

(58) Field of Classification Search
CPC ..... G09F 17/00; G09F 2017/0066; G09F 2017/0083; G09F 2017/0075
See application file for complete search history.

(56) References Cited

U.S. PATENT DOCUMENTS 2,887,983 A * 5/1959 Budd ..... G09F 17/00 116/63 P
2,898,068 A * 8/1959 Warren ..... F16B 2/065 248/183.1
2,977,082 A * 3/1961 Harris ..... A47G 1/17 248/206.5
3,241,516 A * 3/1966 Hopkins ..... H01F 7/0252 116/173
3,540,406 A * 11/1970 Dexter ..... B60R 13/00 116/28 R
3,643,902 A * 2/1972 Gualano ..... G09F 17/00 248/539
3,967,575 A * 7/1976 Coutts ..... B62J 27/00 116/35 A
4,321,883 A * 3/1982 Ruppa ..... B62J 6/20 116/35 A
4,574,726 A * 3/1986 Sullivan ..... G09F 21/04 116/28 R
4,700,655 A * 10/1987 Kirby ..... B60R 13/00 116/174
5,118,058 A * 6/1992 Richter ..... F16C 11/103 248/183.2
5,233,938 A 8/1993 Lalo
5,388,546 A 2/1995 Lombard
5,485,700 A * 1/1996 Van Vranken ..... E04H 12/2238 116/173
5,711,245 A * 1/1998 Knirck ..... B60Q 1/50 116/201
5,899,167 A * 5/1999 Furman ..... G09F 17/00 116/173
6,042,080 A * 3/2000 Shepherd ..... B60R 11/00 248/163.1
D432,945 S 10/2000 Icenhour
6,298,803 B1 10/2001 Gregg
(Continued)

*Primary Examiner* — Nimeshkumar D Patel
*Assistant Examiner* — Tania Courson

(57) ABSTRACT

A locating and identifying device for locating a vehicle includes a pole, a panel, and a coupling means. The panel is coupled to and extends from the pole proximate to a first end of the pole. The coupling means is coupled to a second end of the pole. The coupling means is configured to couple the pole to a vehicle, such as to the roof or to a roof rack, so that the pole extends upwardly from the vehicle to position the panel so that it is viewable to a user, enabling the user to locate and identify the vehicle.

14 Claims, 7 Drawing Sheets

(56) References Cited

U.S. PATENT DOCUMENTS

| | | | | |
|---|---|---|---|---|
| 6,345,587 | B1 * | 2/2002 | Toscano | B60Q 1/484 116/201 |
| 6,378,453 | B1 | 4/2002 | Conway | |
| 6,598,558 | B2 * | 7/2003 | Griffin | G09F 17/00 116/173 |
| 7,051,883 | B2 * | 5/2006 | Angelini | B01D 69/10 162/123 |
| 7,385,526 | B1 | 6/2008 | Bullard | |
| 7,637,226 | B1 * | 12/2009 | Bradley | G09F 15/005 116/173 |
| 7,878,139 | B1 | 2/2011 | Kames | |
| 8,141,839 | B2 * | 3/2012 | Buchner | A63B 55/408 248/516 |
| 9,368,050 | B2 * | 6/2016 | Bigham | G09F 17/00 |
| 9,395,217 | B1 | 7/2016 | Gaor | |
| 9,821,709 | B1 | 11/2017 | Campbell | |
| 10,147,342 | B2 * | 12/2018 | Gogatz | G09F 17/00 |
| 2003/0178809 | A1 * | 9/2003 | Anderson | B60D 1/36 280/477 |
| 2004/0003526 | A1 * | 1/2004 | Brooks | G09F 21/04 40/591 |
| 2006/0086307 | A1 | 4/2006 | Kaz | |
| 2009/0165698 | A1 * | 7/2009 | Lapkin | G09F 17/00 116/173 |
| 2018/0090038 | A1 * | 3/2018 | Kesler | G09F 17/00 |

* cited by examiner

LOCATING AND IDENTIFYING DEVICE

CROSS-REFERENCE TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not Applicable

INCORPORATION-BY-REFERENCE OF MATERIAL SUBMITTED ON A COMPACT DISC OR AS A TEXT FILE VIA THE OFFICE ELECTRONIC FILING SYSTEM

Not Applicable

STATEMENT REGARDING PRIOR DISCLOSURES BY THE INVENTOR OR JOINT INVENTOR

Not Applicable

BACKGROUND OF THE INVENTION

(1) Field of the Invention

(2) Description of Related Art Including Information Disclosed Under 37 CFR 1.97 and 1.98

The disclosure and prior art relates to locating devices and more particularly pertains to a new locating device for locating a vehicle.

BRIEF SUMMARY OF THE INVENTION

An embodiment of the disclosure meets the needs presented above by generally comprising a pole, a panel, and a coupling means. The panel is coupled to and extends from the pole proximate to a first end of the pole. The coupling means is coupled to a second end of the pole. The coupling means is configured to couple the pole to a vehicle, such as to the roof or to a roof rack, so that the pole extends upwardly from the vehicle to position the panel so that it is viewable to a user, enabling the user to locate and identify the vehicle.

There has thus been outlined, rather broadly, the more important features of the disclosure in order that the detailed description thereof that follows may be better understood, and in order that the present contribution to the art may be better appreciated. There are additional features of the disclosure that will be described hereinafter and which will form the subject matter of the claims appended hereto.

The objects of the disclosure, along with the various features of novelty which characterize the disclosure, are pointed out with particularity in the claims annexed to and forming a part of this disclosure.

BRIEF DESCRIPTION OF SEVERAL VIEWS OF THE DRAWING(S)

The disclosure will be better understood and objects other than those set forth above will become apparent when consideration is given to the following detailed description thereof. Such description makes reference to the annexed drawings wherein.

DETAILED DESCRIPTION OF THE INVENTION

Figure 1:
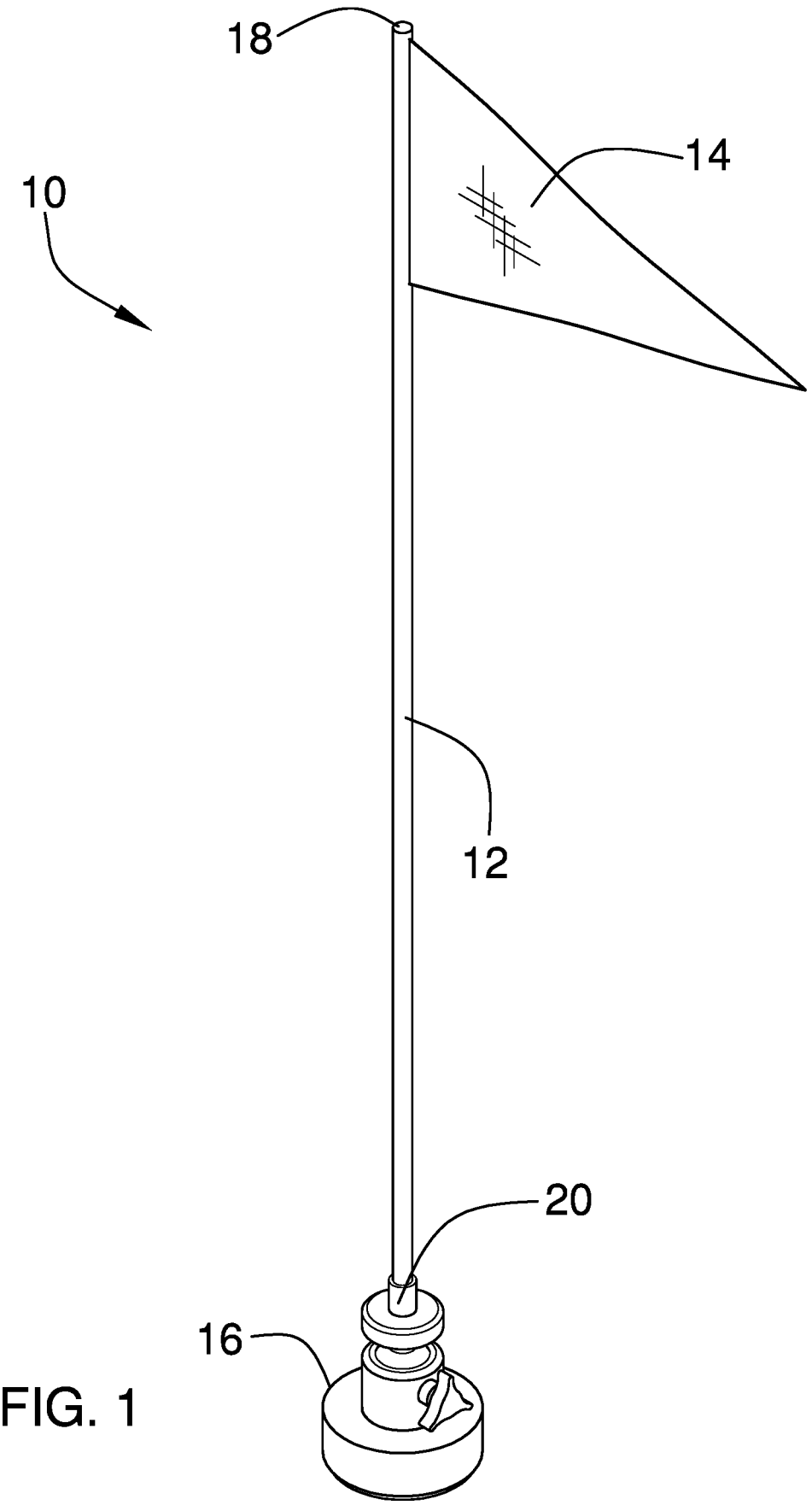
FIG. 1 is an isometric perspective view of a locating and identifying device according to an embodiment of the disclosure.
Figure 2:
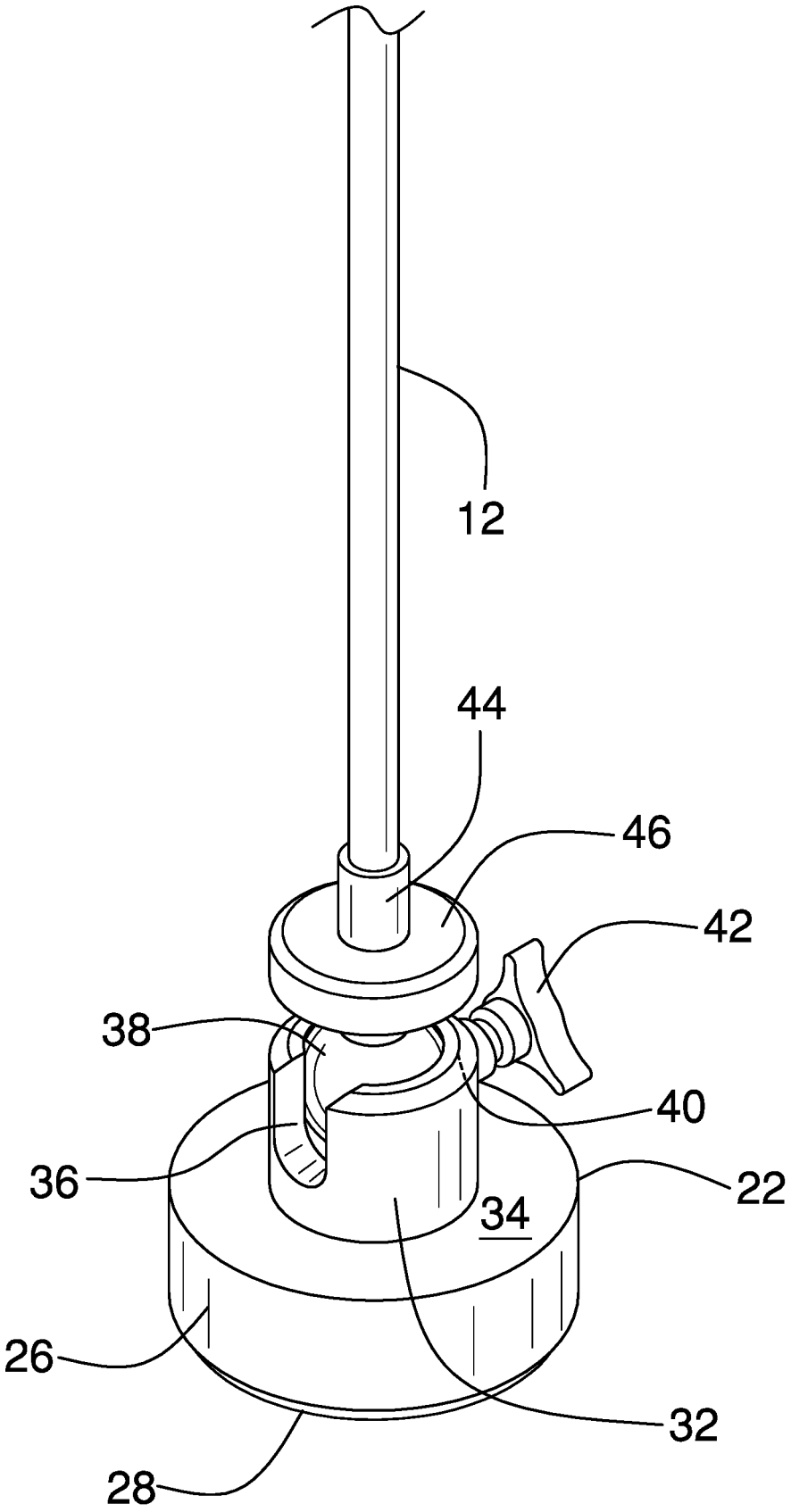
FIG. 2 is a detailed isometric perspective view of an embodiment of the disclosure.
Figure 3:
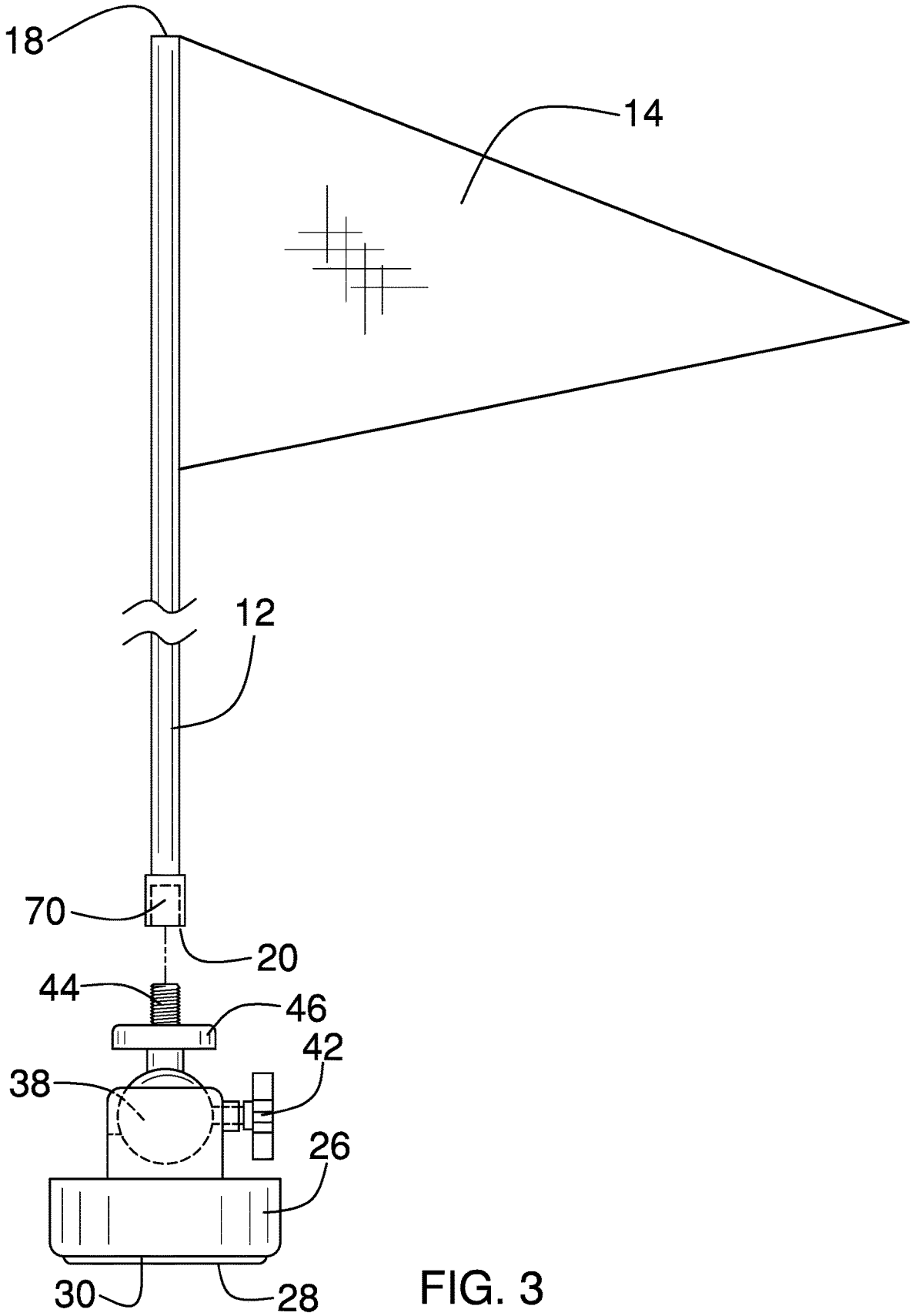
FIG. 3 is a side view of an embodiment of the disclosure.

With reference now to the drawings, and in particular to FIGS. 1 through 7 thereof, a new locating device embodying the principles and concepts of an embodiment of the disclosure and generally designated by the reference numeral 10 will be described.

As best illustrated in FIGS. 1 through 7, the locating and identifying device 10 generally comprises a pole 12, a panel 14, and a coupling means 16. The pole 12 is circularly shaped when viewed longitudinally. The pole 12 comprises fiberglass so that the pole 12 is resiliently bendable.

The panel 14 is coupled to and extends from the pole 12 proximate to a first end 18 of the pole 12. The panel 14 is substantially triangularly shaped. The panel 14 is flexible so that the panel 14 is configured to flap in a breeze. The panel 14 comprises at least one of an aliphatic polyamide and a semi-aromatic polyamide so that the panel 14 is flexible. As will become apparent, the panel 14 may comprise a variety of colors, combination of colors, designs, prints, printing, and shapes so that the panel 14 is personalized for identification purposes.

The coupling means 16 is coupled to a second end 20 of the pole 12. The coupling means 16 is configured to couple the pole 12 to a vehicle, such as to a roof or to a roof rack, so that the pole 12 extends upwardly from the vehicle to position the panel 14 so that it is viewable to a user, enabling the user to locate and identify the vehicle. The device 10 is particularly useful in locating and identifying a vehicle when the vehicle is in a parking facility amongst a large number of vehicles. Being able to quickly locate and identify the vehicle is convenient and useful to the user, particularly in inclement weather or when the user is otherwise in a hurry to locate the vehicle.

The coupling means 16 is at least one of hingedly coupled and pivotally coupled to the pole 12. The coupling means 16 comprises at least one of a magnetic coupler 22 and a clamping coupler 24.

In one embodiment of the invention, as shown in FIGS. 1-6, the magnetic coupler 22 comprises a plate 26, which is disc shaped. A magnet 28 is coupled to a first face 30 of the plate 26. The magnet 28 is configured to removably couple the plate 26 to a paramagnetic element of the vehicle, such as the roof. The magnet 28 is inset into the first face 30 of the plate 26.

Figure 4:
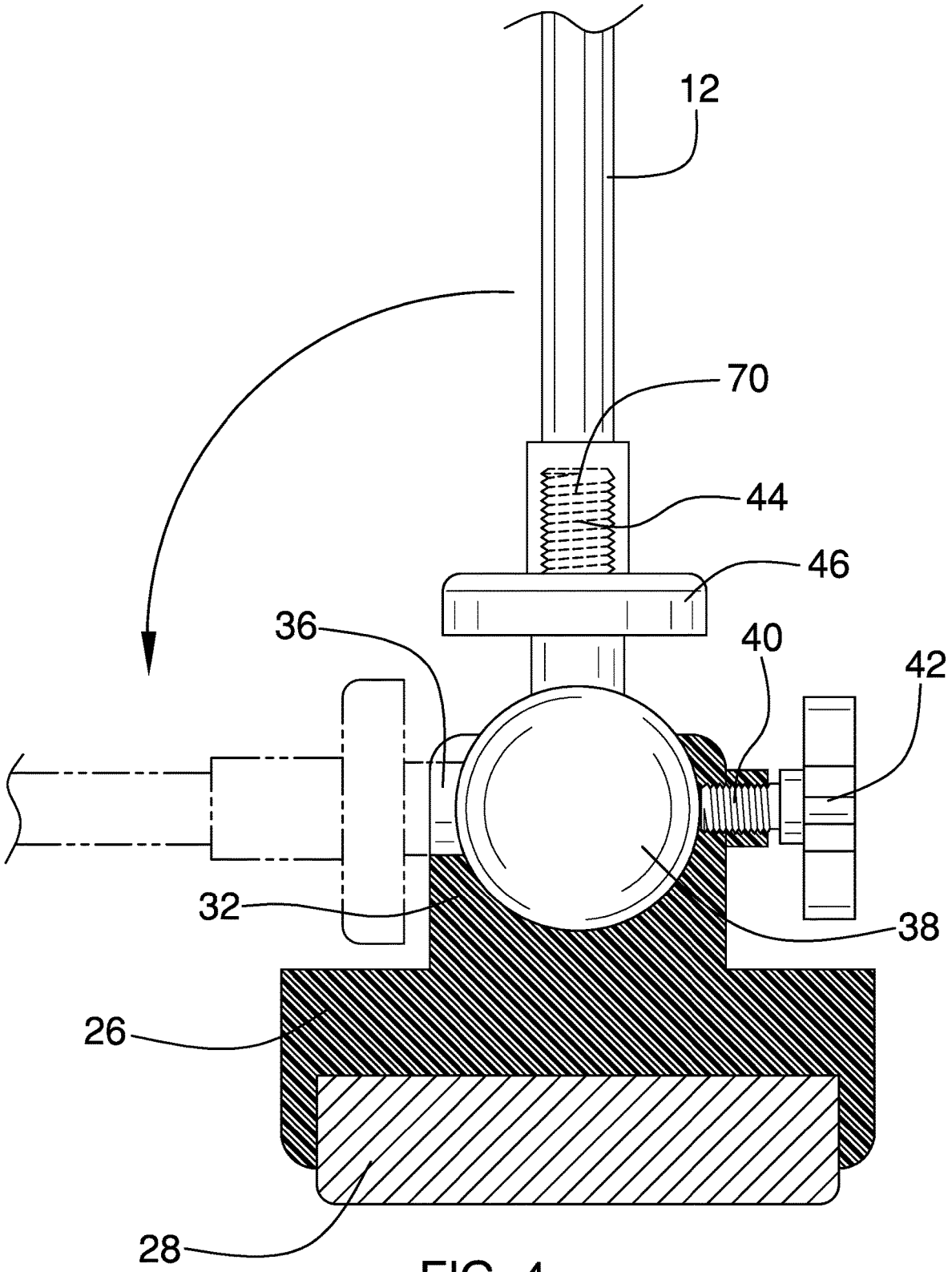
FIG. 4 is a cross-sectional view of an embodiment of the disclosure.
Figure 5:
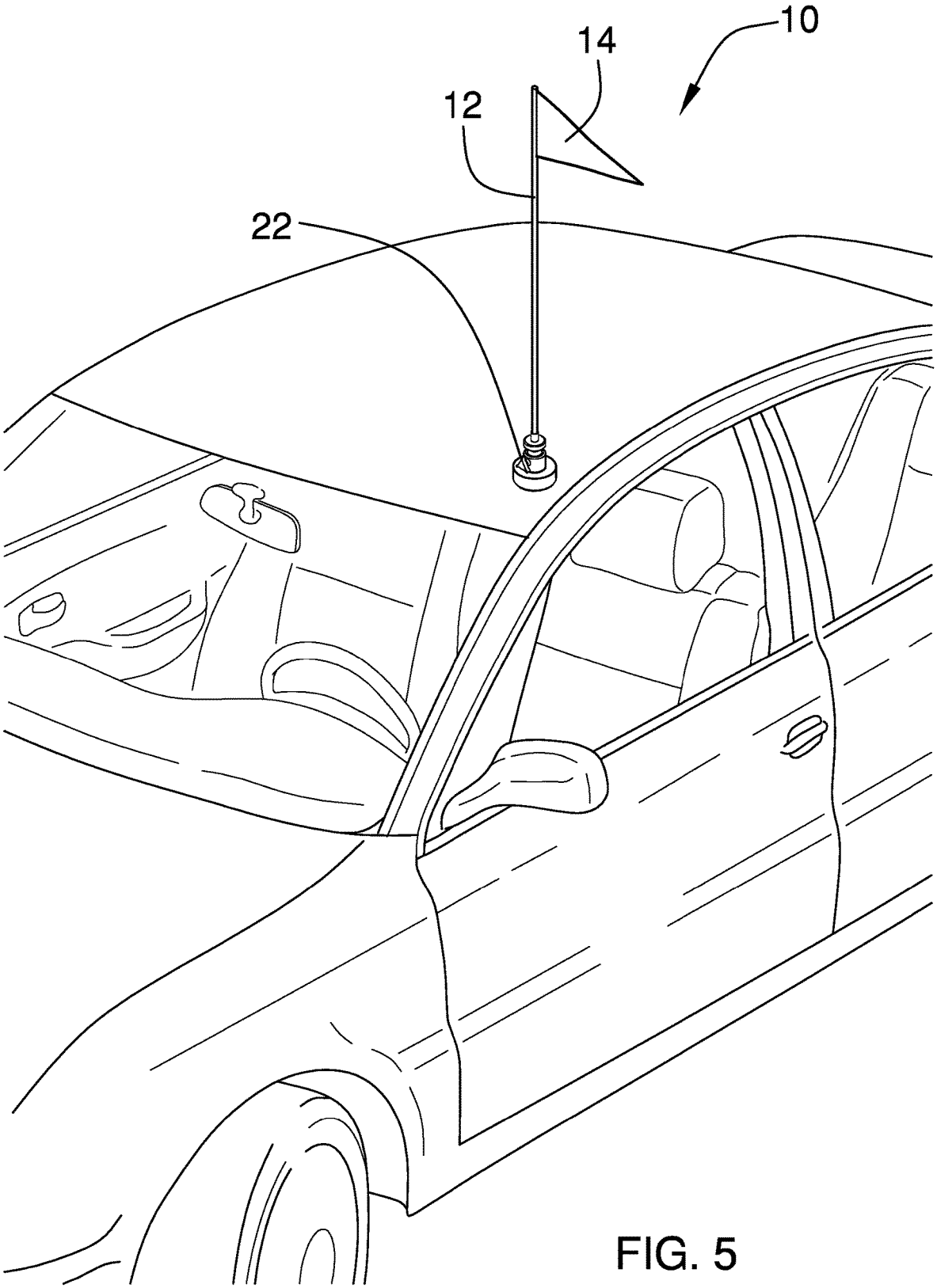
FIG. 5 is an in-use view of an embodiment of the disclosure.
Figure 6:
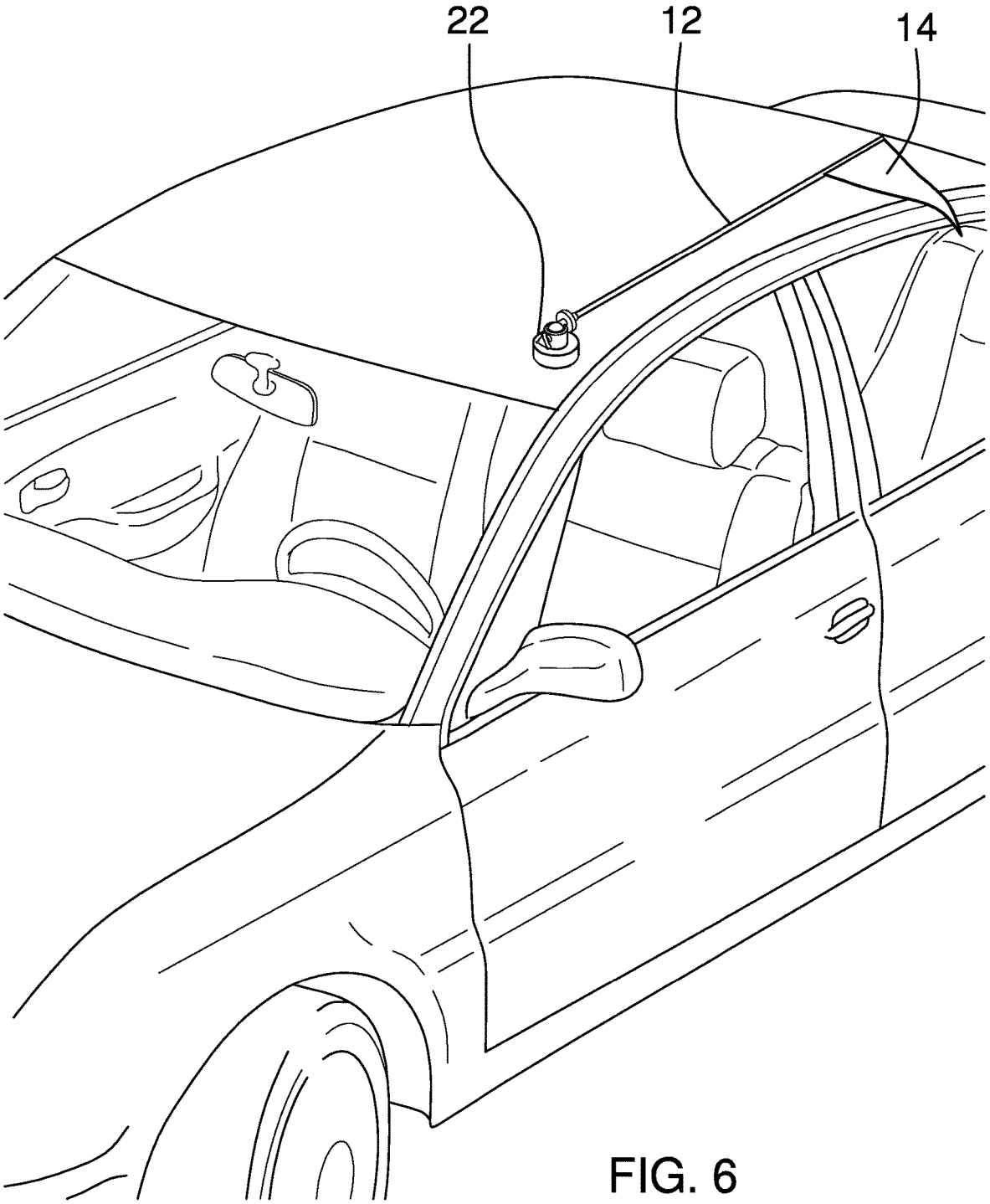
FIG. 6 is an in-use view of an embodiment of the disclosure.

A tube 32 is coupled to and extends from a second face 34 of the plate 26, as shown in detail in FIG. 4. A cutout 36 is positioned in the tube 32 distal from the plate 26. A ball 38 is rotationally coupled to and positioned in the tube 32 so that the ball 38 is rotatable relative to the tube 32. The pole 12 is coupled to and extends from the ball 38 so that the pole 12 is selectively positionable in a deployed configuration and a stowed configuration.

In the deployed configuration, the pole 12 extends substantially perpendicularly from the vehicle and the panel 14 is configured to be viewed by the user, enabling the user to locate and identify the vehicle.

In the stowed configuration, the pole 12 extends through the cutout 36 and is substantially parallel to a top of the vehicle, which allows the user to drive the vehicle with the device 10 in place. Alternatively, the user may elect to decouple the device 10 from the vehicle, by simply detaching the magnet 28 from the paramagnetic element of the vehicle, before driving the vehicle.

A hole 40, which is threaded, is positioned in the tube 32. A thumbscrew 42 that is complementary to the hole 40 is threadedly inserted into the hole 40. The thumbscrew 42 is positioned to be selectively tightened to frictionally couple to the ball 38 to fixedly position the pole 12 relative to the top of the vehicle. The thumbscrew 42 enables the user to selectively lock the pole 12 in the deployed configuration and the stowed configuration.

A rod 44, which threaded, is coupled to and extends from the ball 38. A recess 70, which is internally threaded, extends into the pole 12 from the second end 20 of the pole 12. The recess 70 is positioned to threadedly insert the rod 44 to removably couple the pole 12 to the magnetic coupler 22. The pole 12 being threadedly couplable to the rod 44 provides a means for the user to decouple the pole 12 and the panel 14 from the vehicle while leaving the magnetic coupler 22 in place.

A disk 46 is coupled to and extends radially from the rod 44 proximate to the ball 38. The disk 46 is positioned to be grasped in a hand of the user, allowing the user to motivate the pole 12 between the deployed configuration and the stowed configuration.

Figure 7:
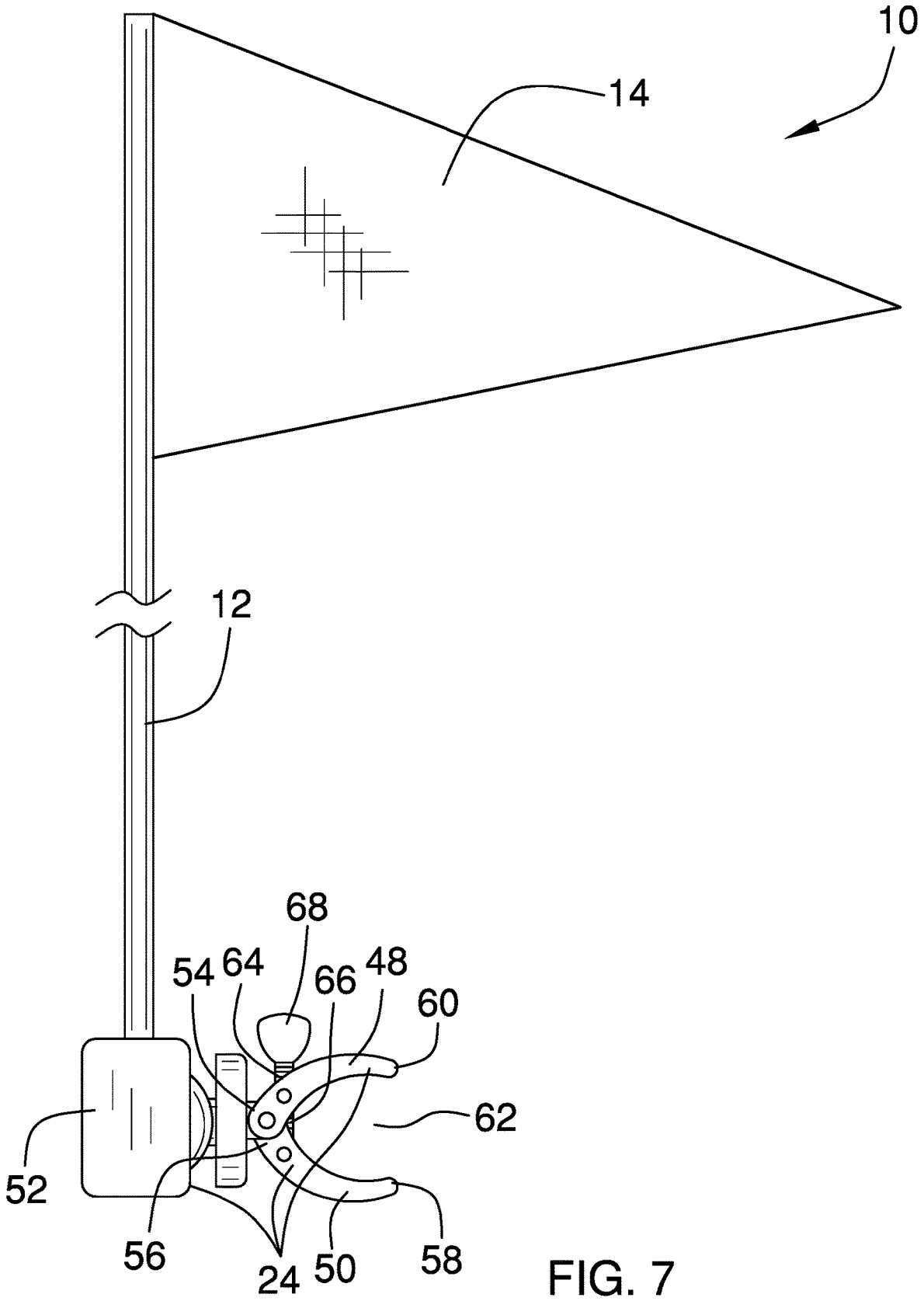
FIG. 7 is an isometric perspective view of an alternative embodiment of the disclosure.

In another embodiment of the invention, as shown in FIG. 7, the clamping coupler 24 comprises a first arm 48, a second arm 50, and a block 52. The block 52 is rotationally coupled to the first arm 48 proximate to a first terminus 54 of the first arm 48. The pole 12 is coupled to and extends from the block 52 so that the pole 12 is hingable relative to the first arm 48. The pole 12 is threadedly coupled to the block 52. The second arm 50 is hingedly coupled by a first endpoint 56 to the first arm 48 proximate to the first terminus 54 of the first arm 48. The first arm 48 and the second arm 50 are substantially C-shaped so that a second endpoint 58 of the second arm 50 and a second terminus 60 of the first arm 48 define a gap 62, which is selectively sizable.

An orifice 64, which is threaded, is positioned in the first arm 48 proximate to the first terminus 54 of the first arm 48. A bolt 66 is threadedly inserted into the orifice 64 and extends to the second arm 50. The bolt 66 is hingedly coupled to the second arm 50. A head 68 of the bolt 66 is configured to be rotated to loosen the bolt 66 to selectively open the gap 62, positioning the user to insert an element of the vehicle into the gap 62. The head 68 of the bolt 66 also is configured to be rotated to tighten the bolt 66 to close the gap 62 to couple the clamping coupler 24 to the element of the vehicle.

In use, the magnet 28 is used to couple the magnetic coupler 22 to the roof of the vehicle. With the pole 12 threadedly coupled to the rod 44, the user is positioned to place the pole 12 in the deployed configuration, and to lock it in place using the thumbscrew 42, when parking amongst other vehicles. Upon returning the parking area, the user is able to locate and identify the vehicle upon sighting the panel 14. The user can then position the pole 12 in the stowed configuration and lock it in place using the thumbscrew 42.

With respect to the above description then, it is to be realized that the optimum dimensional relationships for the parts of an embodiment enabled by the disclosure, to include variations in size, materials, shape, form, function and manner of operation, assembly and use, are deemed readily apparent and obvious to one skilled in the art, and all equivalent relationships to those illustrated in the drawings and described in the specification are intended to be encompassed by an embodiment of the disclosure.

Therefore, the foregoing is considered as illustrative only of the principles of the disclosure. Further, since numerous modifications and changes will readily occur to those skilled in the art, it is not desired to limit the disclosure to the exact construction and operation shown and described, and accordingly, all suitable modifications and equivalents may be resorted to, falling within the scope of the disclosure. In this patent document, the word "comprising" is used in its non-limiting sense to mean that items following the word are included, but items not specifically mentioned are not excluded. A reference to an element by the indefinite article "a" does not exclude the possibility that more than one of the element is present, unless the context clearly requires that there be only one of the elements.

I claim:

1. A locating and identifying device comprising:

a pole;

a panel coupled to and extending from the pole proximate to a first end of the pole; and a coupling means coupled to a second end of the pole wherein the coupling means is configured for coupling the pole to a vehicle such that the pole extends upwardly from the vehicle positioning the panel such that the panel is viewable to a user for locating and identifying the vehicle, the coupling means being at least one of hingedly coupled and pivotally coupled to the pole, the coupling means comprising at least one of a magnetic coupler and a clamping coupler, the magnetic coupler comprising a plate, a magnet coupled to a first face of the plate wherein the magnet is configured for removably coupling the plate to a paramagnetic element of the vehicle, a tube coupled to and extending from a second face of the plate, a cutout positioned in the tube distal from the plate, and a ball rotationally coupled to and positioned in the tube such that the ball is rotatable relative to the tube, the pole being coupled to and extending from the ball such that the pole is selectively positionable in a deployed configuration, wherein the pole extends substantially perpendicularly from the vehicle and the panel is configured for viewing by the user for locating and identifying the vehicle, and a stowed configuration wherein the pole is substantially parallel to a top of the vehicle, a rod coupled to and extending from the ball, the rod being threaded, and a recess extending into the pole from the second end of the pole, the recess being internally threaded such that the recess is positioned for threadedly inserting the rod for removably coupling the pole to the magnetic coupler.

2. The device of claim 1, further including the pole being circularly shaped when viewed longitudinally.

3. The device of claim 1, further including the pole comprising fiberglass such that the pole is resiliently bendable.

4. The device of claim 1, further including the panel being substantially triangularly shaped.

5. The device of claim 1, further including the panel being flexible such that the panel is configured for flapping in a breeze.

6. The device of claim 5, further including the panel comprising at least one of an aliphatic polyamide and a semi-aromatic polyamide such that the panel is flexible.

7. The device of claim 1, further including the plate being disc shaped.

8. The device of claim 1, further including the magnet being inset into the first face of the plate.

9. The device of claim 1, further comprising:

a hole positioned in the tube, the hole being threaded; and a thumbscrew complementary to the hole and threadedly inserted into the hole wherein the thumbscrew is positioned for selectively tightening for frictionally coupling to the ball for fixedly positioning the pole relative to the top of the vehicle.

10. The device of claim 1, further including a disk coupled to and extending radially from the rod proximate to the ball such that the disk is positioned for grasping in a hand of the user for motivating the pole between the deployed configuration and the stowed configuration.

11. The device of claim 1, further including the clamping coupler comprising:

a first arm;

a block rotationally coupled to the first arm proximate to a first terminus of the first arm, the pole being coupled to and extending from the block such that the pole is hingable relative to the first arm;

a second arm hingedly coupled by a first endpoint to the first arm proximate to the first terminus of the first arm, the first arm and the second arm being substantially C-shaped such that a second endpoint of the second arm and a second terminus of the first arm define a gap, the gap being selectively sizable;

an orifice positioned in the first arm proximate to the first terminus of the first arm, the orifice being threaded; and a bolt threadedly inserted into the orifice and extending to the second arm, the bolt being hingedly coupled to the second arm wherein a head of the bolt is configured turning for loosening the bolt for selectively opening the gap and wherein the head of the bolt is configured turning for tightening the bolt for closing the gap.

12. The device of claim 11, further including the pole being threadedly coupled to the block.

13. A locating and identifying device comprising:

a pole, the pole being circularly shaped when viewed longitudinally, the pole comprising fiberglass such that the pole is resiliently bendable;

a panel coupled to and extending from the pole proximate to a first end of the pole, the panel being substantially triangularly shaped, the panel being flexible such that the panel is configured for flapping in a breeze, the panel comprising at least one of an aliphatic polyamide and a semi-aromatic polyamide such that the panel is flexible; and a coupling means coupled to a second end of the pole wherein the coupling means is configured for coupling the pole to a vehicle such that the pole extends upwardly from the vehicle positioning the panel such that the panel is viewable to a user for locating and identifying the vehicle, the coupling means being at least one of hingedly coupled and pivotally coupled to the pole, the coupling means comprising at least one of a magnetic coupler and a clamping coupler, the magnetic coupler comprising a plate, the plate being disc shaped, a magnet coupled to a first face of the plate wherein the magnet is configured for removably coupling the plate to a paramagnetic element of the vehicle, the magnet being inset into the first face of the plate, a tube coupled to and extending from a second face of the plate, a cutout positioned in the tube distal from the plate, a ball rotationally coupled to and positioned in the tube such that the ball is rotatable relative to the tube, the pole being coupled to and extending from the ball such that the pole is selectively positionable in a deployed configuration, wherein the pole extends substantially perpendicularly from the vehicle and the panel is configured for viewing by the user for locating and identifying the vehicle, and a stowed configuration wherein the pole is substantially parallel to a top of the vehicle, a hole positioned in the tube, the hole being threaded, a thumbscrew complementary to the hole and threadedly inserted into the hole wherein the thumbscrew is positioned for selectively tightening for frictionally coupling to the ball for fixedly positioning the pole relative to the top of the vehicle, a rod coupled to and extending from the ball, the rod being threaded, a recess extending into the pole from the second end of the pole, the recess being internally threaded such that the recess is positioned for threadedly inserting the rod for removably coupling the pole to the magnetic coupler, and a disk coupled to and extending radially from the rod proximate to the ball such that the disk is positioned for grasping in a hand of the user for motivating the pole between the deployed configuration and the stowed configuration.

14. The device of claim 13, further including the clamping coupler comprising:

a first arm;

a block rotationally coupled to the first arm proximate to a first terminus of the first arm, the pole being coupled to and extending from the block such that the pole is hingable relative to the first arm, the pole being threadedly coupled to the block;

a second arm hingedly coupled by a first endpoint to the first arm proximate to the first terminus of the first arm, the first arm and the second arm being substantially C-shaped such that a second endpoint of the second arm and a second terminus of the first arm define a gap, the gap being selectively sizable;

an orifice positioned in the first arm proximate to the first terminus of the first arm, the orifice being threaded; and a bolt threadedly inserted into the orifice and extending to the second arm, the bolt being hingedly coupled to the second arm wherein a head of the bolt is configured turning for loosening the bolt for selectively opening the gap and wherein the head of the bolt is configured turning for tightening the bolt for closing the gap.

* * * * *